United States Patent [19]

Sze et al.

[11] 4,059,503

[45] Nov. 22, 1977

[54] STRIPPING AMMONIA FROM LIQUID EFFLUENT OF A HYDRODENITRIFICATION PROCESS

[75] Inventors: Morgan C. Sze, Upper Montclair; Harvey D. Schindler, Fairlawn; Anthony Fanelli, Rockaway, all of N.J.

[73] Assignee: The Lummus Company, Bloomfield, N.J.

[21] Appl. No.: 712,088

[22] Filed: Aug. 5, 1976

[51] Int. Cl.[2] ..... C10G 23/02

[52] U.S. Cl. ..... 208/254 H

[58] Field of Search ..... 208/254 H

[56] References Cited

U.S. PATENT DOCUMENTS

| | | | |
|---|---|---|---|
| 3,026,260 | 3/1962 | Watkins | 208/254 H |
| 3,145,160 | 8/1964 | Jacobson | 208/254 H |
| 3,215,617 | 11/1965 | Burch et al. | 208/254 H |
| 3,717,571 | 2/1973 | Schulman | 208/254 H |

*Primary Examiner*—George Crasanakis
*Attorney, Agent, or Firm*—Marn & Jangarathis

[57] ABSTRACT

A nitrogen containing feedstock is hydrodenitrified by passing the feed through at least two hydrodenitrification zones, with ammonia produced in the hydrodenitrification being purged from the system prior to the last hydrodenitrification zone to maintain a low ammonia partial pressure in the last hydrodenitrification zone. The ammonia is preferably purged by stripping ammonia from the liquid portion of the effluent withdrawn from the next to last hydrodenitrification zone. Improved denitrification is obtained by maintaining a low ammonia partial pressure in the last hydrodenitrification zone.

8 Claims, 1 Drawing Figure

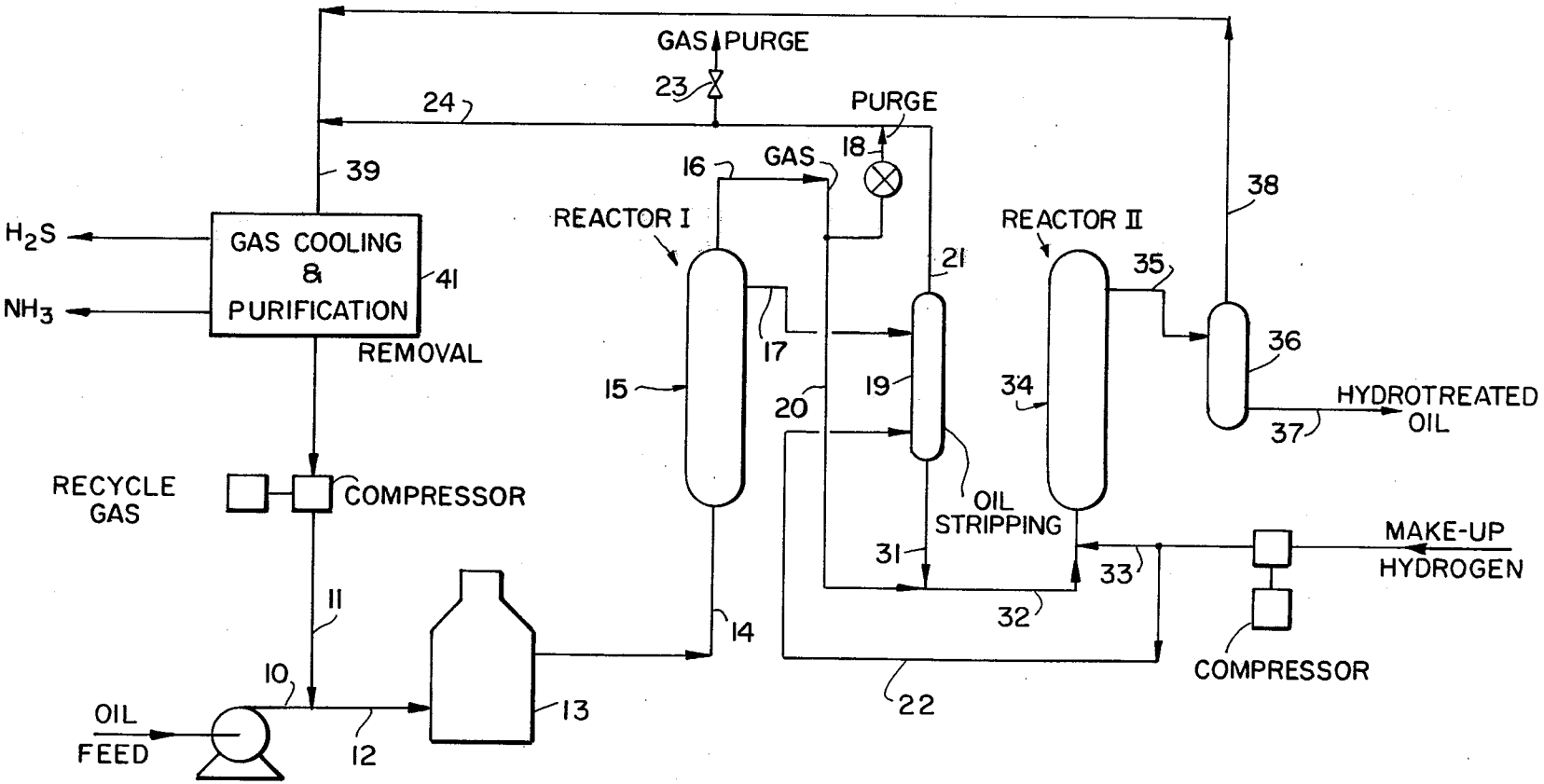
HYDROTREATED OIL
MAKE-UP HYDROGEN
COMPRESSOR
REACTOR II
OIL STRIPPING
PURGE
GAS
GAS PURGE
REACTOR I
GAS COOLING & PURIFICATION
REMOVAL
COMPRESSOR
RECYCLE GAS
OIL FEED
$H_2S$
$NH_3$
10
11
12
13
14
15
16
17
18
19
20
21
22
23
24
31
32
33
34
35
36
37
38
39
41

STRIPPING AMMONIA FROM LIQUID EFFLUENT OF A HYDRODENITRIFICATION PROCESS

This invention relates to the treatment of carbonaceous feedstocks, and more particularly, to a new and improved process for the denitrification of a carbonaceous feedstock.

In many cases, it is highly desirable to remove nitrogen compounds from a carbonaceous feedstock obtained from either petroleum or coal sources. Thus, for example, in the case where the carbonaceous feedstock is to be employed as a fuel, it is required to reduce the nitrogen content thereof in order to reduce the emission of oxides of nitrogen. Also, in many cases, where a carbonaceous feedstock is to be subsequently processed, the nitrogen content should be reduced in that the subsequent processing may require low nitrogen contents; for example, hydrocracking of distillates. In recent years, attention has been directed towards the hydrodenitrification of high boiling fractions, such as residual oils, crudes with high concentrations of sulfur, nitrogen, and organometallic compounds, and synthetic crudes derived from coal, shale, and tar sands. As a result of the high nitrogen contents of such high boiling fractions, numerous difficulties have been encountered in attempting to reduce the nitrogen contents thereof to acceptable amounts.

An object of the present invention is to provide a new and improved process for effecting the denitrification of carbonaceous feedstocks.

Another object of the present invention is to provide a new and improved process for effecting the hydrodenitrification of high boiling fractions.

These and other objects of the present invention will be more readily apparent from reading the following detailed description thereof.

In accordance with the present invention, there is provided a process for the hydrodenitrification of a nitrogen containing feed wherein the hydrodenitrification is effected in a series of hydrodenitrification zones containing at least two hydrodenitrification zones by contacting the nitrogen containing feed under hydrodenitrification conditions with gaseous hydrogen to convert nitrogen present in the feed to ammonia, with ammonia being purged from the system prior to the last hydrodenitrification zone to maintain a low ammonia partial pressure in the last hydrodenitrification zone. Applicant has found that the partial pressure of ammonia present in the last hydrodenitrification zone influences the denitrification, with a high ammonia partial pressure adversely affecting the denitrification of the carbonaceous feed. As a result, in accordance with the present invention, ammonia is purged from the system, prior to the last hydrodenitrification zone in order to maintain a low ammonia partial pressure in the last hydrodenitrification zone and thereby improve the denitrification in the last hydrodenitrification zone.

In accordance with the present invention, ammonia is purged from the system prior to the last hydrodenitrification zone by separating ammonia from at least the liquid portion of the effluent withdrawn from a hydrodenitrification zone prior to the last hydrodenitrification zone, with such zone preferably being the hydrodenitrification zone immediately prior to the last hydrodenitrification zone. In accordance with the present invention, Applicant found that a significant portion of the ammonia produced in the hydrodenitrification is present in the liquid portion of the effluent whereby ammonia can be effectively purged from the system by removing ammonia from at least the liquid portion of the effluent withdrawn from a hydrodenitrification zone prior to the last hydrodenitrification zone to maintain a low ammonia partial pressure in the last zone and thereby improve denitrification in the last zone. In general, the partial pressure of ammonia in the last hydrodenitrification zone is no greater than about 40 psi, and preferably no greater than about 30 psi with ammonia being purged from the system in order to provide such reduced ammonia partial pressures. Although it would be preferred to purge essentially all of the ammonia from the system, prior to the last hydrodenitrification zone, as a practical matter, such complete purging is not possible. As a result, in general, the ammonia partial pressure in the last hydrodenitrification zone is in the order of from about 5 psi to about 20 psi. The ammonia may be conveniently separated from the liquid effluent by stripping ammonia from the liquid portion of the effluent at temperatures and pressures corresponding to those employed for effecting hydrodenitrification.

A portion of the ammonia to be purged from the system prior to the last hydrodenitrification zone may be purged by separate withdrawal of a gas stream from a prior zone and purging of a portion of the gas stream.

In accordance with a preferred aspect of the present invention, fresh hydrogen feed for the hydrodenitrification is introduced into the last hydrodenitrification zone in order to provide for reduced ammonia partial pressure, with the excess hydrogen withdrawn from the last hydrodenitrification zone being recycled to the remaining hydrodenitrification zones prior to said last hydrodenitrification zone.

In each of the hydrodenitrification zones of the series of hydrodenitrification zones employed in the present invention, the hydrodenitrification is effected by contacting the feed with hydrogen at hydrodenitrification conditions, as known in the art, in the presence of a hydrodenitrification catalyst, as known in the art. In general, such hydrodenitrification is effected at a temperature from about 500° F to about 875° F, preferably from about 650° F. to 825° F. The hydrodenitrification is generally effected at pressures from about 500 to 4,000 psig. The hydrogen through-put is generally maintained above about the 500 S.C.F. per barrel of feed, and is preferably in the order of from about 1,000 to 10,000 S.C.F. per barrel. The hydrogen is provided in an amount in excess of that required to supply that consumed in the conversion of the nitrogen compounds and to compensate for any hydrogenation of other components of the feedstock. The flow of feedstock relative to the catalyst is generally in the order of from about 0.2 to 10 L.H.S.V. The catalyst employed for the hydrodenitrification is any one of a wide variety of catalysts which are known to be effective for the hydrodenitrification of feedstocks, with such catalysts generally comprising sulfided chromium, tungsten, and/or molybdenum oxides together with iron, cobalt, and/or nickel oxides, on a suitable support. The catalyst which is preferably employed in the present invention is a catalyst as described in U.S. Application Ser. No. 574,255, filed on May 5, 1975. The catalyst, which is a supported sulfided catalyst containing molybdenum, nickel and iron, with the molybdenum being present in an amount from about 10% to about 20%, preferably from about 13% to about 17%, all by weight, calculated as $MoO_3$, based on total catalyst weight, the iron being present in an iron to molybdenum atomic ratio from 0.05 to about 0.5, preferably from about 0.1 to about 0.3, and the nickel being present in a nickel to molybdenum atomic ratio of from about 0.2 to about 0.6, and preferably from about 0.3 to about 0.5, has been found to be particularly effective for effecting hydrodenitrification in accordance with the present invention. It is to be understood, however, that the scope of the present invention is not limited to such preferred catalysts.

The contacting of hydrogen and the feed to be denitrified can be effected in any one of a wide variety of ways known in the art, including a fixed bed, fluidized bed, expanded bed, etc. The contacting is generally effected by co-current flow of hydrogen and the feed through the series of hydrodenitrification reactors, with the series containing at least two hydrodenitrification reactors. The choice of the optimum procedure for effecting contact of the hydrogen, feedstock and catalyst is deemed to be within the scope of those skilled in the art from the teachings herein.

The present invention is particularly applicable to treating feedstocks (petroleum and/or coal derived feeds) having a high nitrogen content; i.e., a nitrogen content in excess of 0.5 weight %, generally in the order of from about 0.75 weight % to 2 weight %. Such feedstocks are high boiling fractions, such as obtained from residual oils, crudes, and synthetic crudes derived from coal, shale, tar sands and the like. The feed may be in liquid form or as a solid dispersed in a liquid (coal slurried in a pasting solvent). In accordance with the present invention, it is possible to reduce the nitrogen contents of such feeds to below 0.5 weight %, and in general, to less than about 0.3 weight %.

The present invention will be further described with respect to the accompanying drawing, wherein:

The drawing is a simplifid schematic flow diagram of an embodiment of the present invention.

It is to be understood, however, that the scope of the present invention is not to be limited to the embodiment particularly described with reference to the accompanying drawing.

Referring now to the drawing, a carbonaceous feed, in line 10, such as a liquid coal or petroleum feed or a coal slurry in a suitable pasting solvent, which is to be denitrified is combined with a hydrogen containing recycle gas stream, in line 11, obtained as hereinafer described, and the combined stream in line 12 is passed through a heater, schematically designated as 13, to heat the combined feed to hydrodenitrification conditions. The heated stream in line 14 is introduced into a hydrodenitrification reactor 15 including a suitable denitrification catalyst. As shown, the reactor is an upflow co-current reactor; however, it is to be understood that the reactor could be a downflow co-current reactor. In reactor 15, hydrodenitrification is effected, with nitrogen compounds being converted to ammonia.

As particularly described, the series of hydrodenitrification reactors employed for effecting hydrodenitrification of the initial feed includes only two reactors and, accordingly, the embodiment will be described with respect to effecting ammonia purge by separating ammonia from the effluent withdrawn from reactor 15, which is both the initial and next to last reactor. It is to be understood, however, that if more than two reactors are employed then the ammonia purge is preferably effected by separating ammonia from at least the liquid effluent withdrawn from the reactor immediately preceding the last reactor, rather than the initial reactor, although it is also possible, but less preferred, to purge ammonia from a reactor other than the next to last reactor.

In accordance with the preferred embodiment, gaseous and liquid effluents are separately withdrawn from reactor 15 through lines 16 and 17, respectively, in order to facilitate stripping of ammonia from the liquid portion of the effluent. It is to be understood, however, that it is possible, although less preferred, to withdraw a combined stream from reactor 15 and subject the combined stream to a stripping operation to separate ammonia therefrom.

The liquid portion of the effluent withdrawn from reactor 15 through line 17 is introduced into a stripping column, schematically designated as 19, to strip ammonia therefrom. As hereinabove noted, Applicant has found that a significant portion of the generated ammonia is dissolved in the liquid portion of the effluent whereby ammonia can be effectively purged from the system by separating ammonia from such liquid portion of the effluent. In stripper 19, ammonia is stripped from the liquid effluent, with the stripped ammonia being withdrawn from the oil stripper through line 21. The ammonia is stripped from the gas at temperatures and pressures corresponding to those employed in the hydrodenitrification; in general, temperatures in order of from about 500° F to about 875° F, preferably from about 650° F to about 825° F, and a column total pressure of in the order of from about 500 psig to about 4,000 psig, and preferably from about 1000 psig to about 3,000 psig. The stripping of ammonia from the liquid portion of the effluent in stripper 19 may be facilitated by the introduction of a stripping gas through line 22. As particularly shown, the stripping gas requirements are provided by a portion of the compressed hydrogen feed; however, it is to be understood that a stripping gas other than hydrogen could also be employed.

The gas overhead in line 21 generally contains, in addition to ammonia, hydrogen and light hydrocarbons produced in the hydrodenitrification reactors. Depending on the amount of such other components, the overhead stream 21 may be directly purged from the system; however, in most cases, only a portion of the gaseous overhead in line 21 is purged through line 23, with the remainder of the gas being recycled as hereinafter described.

A gaseous portion of the effluent is withdrawn from reactor 15 through line 16, and a portion of the gas may be directly purged through line 18 to provide a portion of the ammonia purge requirements for providing the desired ammonia partial pressure in the last hydrodenitrification reactor. The unpurged portion of the gas in line 20, is combined with the stripped liquid portion of the effluent withdrawn from stripping column 19 through line 31.

It is to be understood that all of the ammonia need not be purged from the system with the amount of ammonia being purged through line 23, and if required, through line 18 being sufficient to provide the reduced ammonia partial pressure desired for the last denitrification reactor.

The combined stream in line 32 which corresponds to the effluent withdrawn from reactor 15, less the amounts purged from the system, is combined with compressed hydrogen make-up in line 33 for introduction into the last hydrodenitrification reactor 34, including a suitable denitrification catalyst to complete denitrification of the feed.

A denitrified effluent is withdrawn from reactor 34 through line 35 and introduced into a separator 36 to separate the liquid and gaseous portions of the effluent.

The denitrified liquid product is recovered from separator 36 through line 37.

The gaseous portion of the effluent, containing hydrogen, some ammonia, hydrogen sulfide and some light hydrocarbons, is withdrawn from separator 36 through line 38 and combined with the unpurged portion of the stripped gas in line 24. The combined stream in line 39 is introduced into a separation zone 41 to effect purification of the hydrogen recycle stream by separating all or a portion of the hydrogen sulfide, ammonia, light hydrocarbons, etc. therefrom. A hydrogen recycle stream withdrawn from purification zone 41 is compressed and passed through line 11 for combination with the feed to be denitrified.

The present invention will be further described with respect to the following examples; however, the scope of the invention is not to be limited thereby.

EXAMPLE

A coal having the analysis of Table I slurried in a pasting solvent in an amount of 35 wt. % is hydrodenitrified in two hydrodenitrification zones, containing supported molybdenum-nickel-iron denitrification catalyst, as described with reference to the embodiment of the drawing. Run 1 is effected without ammonia purge, whereas Run 2 is effected with ammonia purge according to the invention. The conditions are listed in Table II.

Table I

| Coal Analysis | Wt. % |
|---|---|
| Carbon | 66.2 |
| Hydrogen | 4.9 |
| Nitrogen | 1.2 |
| Sulfur (total) | 3.9 |
| Mineral Matter | 9.7 |
| Water | 3.0 |
| Organic Oxygen | 11.1 |
| | 100.0 |

Table II

| Hydroliquiefaction Runs | Stream No. | Run 1 | Run 2 |
|---|---|---|---|
| Reaction Temperature, ° F | | 750 | 750 |
| Reaction Pressure, psig | | 1400 | 1400 |
| LHSV, $hr^{31\,1}$ (1) | | 1.8 | 1.8 |
| Flows in Figure 1, lb/hr | | | |
| Coal paste feed | 10 | 31.12 | 31.12 |
| Coal in paste feed | 10 | 10.89 | 10.89 |
| Nitrogen in coal feed | 10 | 0.131 | 0.131 |
| Make-up hydrogen | 33 | 0.309 | 0.290 |
| Stripping Hydrogen | 22 | 0 | 0.025 |
| Recycle gas (moles/hr) | 11 | 0.950 | 0.950 |
| Ammonia in Purge | 23 | 0 | 0.049 |
| Ammonia removed | 41 | 0.104 | 0.078 |
| Total ammonia eliminated | | 0.104 | 0.127 |
| Nitrogen Removed, % | | 65.3 | 80.0 |

(1) volume coal paste feed per hour per total catalyst volume.

The products include hydrocarbon gases, light oils down to naphtha, and heating oil with an initial boiling point above 400° F. The 400° F+ fraction contains almost all of the nitrogen remaining after the ammonia is removed and the analysis is as follows:

Table III

| Nitrogen Contained In Net Heavy Oil Product | Run 1 | Run 2 |
|---|---|---|
| Net Product Obtained: | | |
| 400° F + oil per ton coal feed, lbs. | 920 | 920 |
| Nitrogen contained in oil, lbs. | 5.06 | 2.76 |
| Nitrogen, weight % | 0.55 | 0.30 |

Thus, by effecting ammonia purge in accordance with the invention, there is a significant reduction in nitrogen content.

The present invention is particularly advantageous in that improved denitrification can be obtained in a process employing a series of denitrification zones by purging ammonia from the system prior to the last denitrification zone to thereby reduce the ammonia partial pressure therein. Applicant has found that higher ammonia partial pressures adversely affect denitrification, and in fact, can prevent further denitrification of the feed. The invention is also particularly advantageous in that ammonia can be purged from the system between reaction stages without the necessity of cooling all or a portion of the effluent between the stages which would necessitate reheating thereof. In addition, by effecting ammonia removal from the liquid portion of the effluent, it is possible to effectively purge ammonia without purging large quantities of hydrogen. These and other advantages should be apparent to those skilled in the art from the teachings herein.

Numerous modifications and variations of the present invention are possible in light of the above teachings and, therefore, within the scope of the appended claims, the invention may be practiced otherwise than as particularly described.

What is claimed is:

1. In a process for the hydrodenitrification of a nitrogen containing feed by sequentially passing the feed through a series of hydrodenitrification zones containing at least two hydrodenitrification zones, wherein the nitrogen containing feed is contacted with hydrogen under hydrodenitrification temperature and pressure conditions to convert nitrogen present in the feed to ammonia, and wherein ammonia is purged from a hydrodenitrification zone effluent prior to the last hydrodenitrification zone in said series of hydrodentrification zones to maintain a low ammonia partial pressure in the last hydrodenitrification zone, the improvement comprising:

a. separately separating a gaseous effluent and a liquid effluent from said hydrodenitrification zone prior to said last hydrodenitrification zone;

b. stripping ammonia from said liquid effluent of step (a); and c. introducing at least a portion of said gaseous effluent from step (a) and stripped liquid effluent from step (b) into the next hydrodenitrification zone, said separating of step (a), stripping of step (b) and introducing of step (c) being effected without cooling of the liquid and gaseous effluents to a temperature below hydrodenitrification temperatures.

2. The process of claim 1 wherein ammonia is stripped from the liquid effluent in step (b) from the next to the last hydrodenitrification zone.

3. The process of claim 1 wherein the ammonia partial pressure in the last hydrodenitrification zone is no greater than about 40 psi.

4. The process of claim 3 wherein make-up hydrogen is introduced into the last hydrodenitrification zone and excess hydrogen recovered from the last hydrodenitrification is recycled to the previous hydrodenitrification zones.

5. The process of claim 4 wherein the hydrodenitrification is effected in the presence of a supported sulfided catalyst containing molybdenum, nickel and iron, the molybdenum being present in an amount of from 10% to 20%, by weight, calculated as $MoO_3$, the iron to molybdenum atomic ratio being from 0.05 to 0.5 and the nickel to molybdenum atomic ratio being from 0.2 to 0.6.

6. The process of claim 3 wherein the nitrogen containing feed contains in excess of 0.5 weight percent of nitrogen.

7. The process of claim 6 wherein the feed is derived from coal.

8. The process of claim 7 wherein the ammonia partial pressure in the last hydrodenitrification zone is from 5 to 2 psi.

* * * * *

UNITED STATES PATENT OFFICE

CERTIFICATE OF CORRECTION

Patent No. 4,059,503 Dated November 22, 1977

Inventor(s) Morgan C. Sze et al

It is certified that error appears in the above-identified patent and that said Letters Patent are hereby corrected as shown below:

Col. 3, line 36, delete "simplifid" and insert --simplified--;
line 65, after "employed", insert --,--.
Col. 5, line 28, after "supported", insert --sulfided--;
line 51, "LHSV, $hr^{31\ 1}$" should read --LHSV, $hr^{-1}$--.
Col. 8, line 10, "2 psi" should be --20 psi--.

Signed and Sealed this

Eleventh Day of April 1978

[SEAL]

Attest:

RUTH C. MASON
Attesting Officer

LUTRELLE F. PARKER
Acting Commissioner of Patents and Trademarks